United States Patent [19]

Anderson et al.

[11] Patent Number: 4,651,136

[45] Date of Patent: Mar. 17, 1987

[54] PULSED MAGNETIC RELEASE MECHANISM

[75] Inventors: Philip M. Anderson, Madison; Ronald K. Reich, Florham Park; Richard C. Ujazdowski, Flemington, all of N.J.

[73] Assignee: Allied Corporation, Morris Township, Morris County, N.J.

[21] Appl. No.: 772,213

[22] Filed: Sep. 3, 1985

[51] Int. Cl.[4] ..... A44B 21/075; G08B 13/18

[52] U.S. Cl. ..... 340/572; 24/110; 24/155 BR; 335/219; 340/551

[58] Field of Search ..... 340/572, 557; 24/155 BR, 155 R, 110; 292/251.5; 403/DIG. 1; 335/219

[56] References Cited

U.S. PATENT DOCUMENTS 3,974,581 8/1976 Martens et al. ..... 340/572

4,339,853 7/1982 Lipschitz ..... 24/155 BR

*Primary Examiner*—Glen R. Swann, III

*Attorney, Agent, or Firm*—Ernest D. Buff; Gerhard H. Fuchs

[57] ABSTRACT

An electromagnetic release apparatus and method are provided for unfastening a magnetically actuated surveillance marker clip assembly from an article. The release apparatus includes a primary solenoid coil that, when energized, produces a magnetic field of sufficient force to initially unlock the clip assembly for removal. A secondary magnet produces another magnetic field sufficient in force to retain the clip assembly in the unlocked position. The secondary magnet is mounted to a piston slidably received in the central bore of the primary solenoid coil. The primary solenoid coil is energized by inserting the clip assembly into the central bore of the coil, thereby, pressing the piston downwardly until it closes a "one-shot" microswitch. The electrical charge of a capacitor is then discharged through the primary coil to produce the relatively high power magnetic field for unlocking the clip assembly. A clip assembly removal reminder system assures proper processing of an article and removal of the clip assembly by the clerk or cashier. The system includes an interrogation and detection circuit for detecting the presence of a clip assembly at a final checkout station. An alarm remains continuously activated until the clip assembly is removed from the final checkout station and the release apparatus is activated to remove the clip assembly from the article.

21 Claims, 6 Drawing Figures

PULSED MAGNETIC RELEASE MECHANISM

TECHNICAL FIELD

The present invention relates generally to article surveillance systems and markers for use therein. More particularly, the invention provides an electromagnetic release mechanism for unfastening a surveillance marker clip assembly from an article to be removed from a protected zone following checkout or purchase from authorized personnel.

DESCRIPTION OF THE PRIOR ART

The theft of merchandise from retail stores is a rapidly increasing problem in recent years. Thus, merchandise protection is of growing concern and importance to retailers.

Numerous technical solutions to the theft problem have been developed. Among them is the securing of an identifiable marker to an individual article of merchandise to be protected. An example of such a tagging or marking system is found in U.S. Pat. No. 4,510,489 to Anderson, III, et al., entitled SURVEILLANCE SYSTEM HAVING MAGNETOMECHANICAL MARKER and assigned to Allied Corporation, the assignee of the present invention. The marker preferably includes an elongated, amorphous metal strip or ribbon adapted to be magnetically biased and thereby armed to resonate mechanically at a frequency within the frequency band of a magnetic interrogation field.

A transmitting apparatus including a drive coil is situated on one side of a passageway leading to an exit from the premises. A receiving apparatus including a receive coil is positioned at the opposite side of the passageway. The drive coil sweeps through a predefined spectrum of frequencies including the resonant frequency of the target ribbon of the marker.

As the drive frequency passes through the resonant frequency of the marker ribbon, the marker generates a distinctive increase in the voltage induced in the receive coil. This marked effect upon the fundamental frequency of the induced voltage allows simple and accurate marker detection even in the presence of other objects. Of course, detection indicates that the marker has not been properly deactivated or removed from the marked article by the cashier at the checkout counter and, therefore, that the article is not properly checked out and/or purchased.

As should be appreciated, in order to prevent theft, markers of this type must be very difficult for a potential shoplifter to remove from the article. Conversely, however, the markers must be easy to release for authorized store personnel such as the cash register attendant. Thus, it is clear that the marker should be designed for release from an article only by means of a specially designed apparatus or tool only in the possession of authorized store personnel.

Typically, such mechanical release apparatus are small, hand-held tools subject to being copied or stolen. The thief may then use the copied or stolen tool to remove markers from the store merchandise and then steal the merchandise at will without sounding the marker actuated alarm.

In order to overcome this problem, it is proposed that the marker locking or fastening mechanism should only be releasable by means of a specially designed electromagnetically powered release apparatus that is positioned adjacent the checkout counter. Such an apparatus or device is not subject to being stolen and used by a thief and, of course, may be conveniently used by the cashier to remove markers from purchased goods.

U.S. Pat. No. 3,911,534 to Martens et al, discloses an electromagnetic marker releasing or detaching tool. The marker detaching tool includes a coil and overload protection circuitry in the form of relays that prevent the coil from overheating during operation. The Martens detaching device is, however, not without its disadvantages and, therefore, is subject to improvement.

Specifically, since the coil of the detaching tool is continuously fully energized as each marker is removed from an article, overheating of the coil during, for example, peak shopping periods is not uncommon. While the overload protection circuitry provided will prevent damage to the coil, it should be recognized that marker removal is not possible during the period of time that the overload circuitry is actuated and the coil is cooling. Thus, customers may be kept waiting in a checkout line. Such an inconvenience is not readily understood or appreciated by customers.

Furthermore, the Martens detaching tool fails to include any mechanism or system to remind the cashier to remove the marker from a purchased article. Should the cashier forget to remove a marker, as is quite possible during busy check-out periods, the customer would activate the alarm upon leaving the store. When the goods have been properly purchased, such a "false" alarm is embarassing both to the customer and store personnel. Additionally, not only could such a situation lead to the loss of a valued customer, but an adverse legal action against the retailer could also result.

SUMMARY OF THE INVENTION

Accordingly, it is a primary object of the present invention to provide an electromagnetic release apparatus for removing a surveillance marker clip assembly from an article to be protected that overcomes the above-described limitations and disadvantages of the prior art.

Another object of the invention is to provide a powerful electromagnetic release mechanism that is not subject to overheating during continued and frequent use such as may occur during busy shopping periods of a retail outlet.

Still another object of the invention is to provide an apparatus and method of releasing a marker clip assembly from an article with improved effectiveness and efficiency.

A still further object of the present invention is to provide an electromagnet release apparatus that is simple to construct while providing smooth and reliable operations at all times.

An additional object of the present invention is to provide a marker clip assembly releasing or detaching apparatus that reminds an attendant to properly process an article by removing the marker.

Additional objects, advantages, and other novel features of the invention will be set forth will become apparent to those schooled in the art upon examination of the following or may be learned with practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved electromagnetic releasing or detaching apparatus and method are provided for removing a surveillance marker clip assembly or the like from an article to be protected. The clip assembly includes a magnetically actuated locking mechanism for fastening the marker assembly to the article. The release apparatus includes a primary electromagnet. When actuated, this primary electromagnet produces a first magnetic field of sufficient force to draw the marker locking mechanism open. A secondary magnet produces a second magnetic field of sufficient force to retain the marker locking mechanism in the open position once opened by the primary electromagnet.

Preferably, as an integral part of the improved apparatus the primary electromagnet is in the form of a solenoid coil operated by the pulsed discharge of a capacitor. This concept of pulsing the primary electromagnet prevents overheating of the system as has been a problem in the past. The secondary magnet may be in the form of a permanent magnet or a relatively low current, low power electromagnet that produces a magnetic field of just sufficient force to retain the locking mechanism in the open position.

A piston is slidably received in the central bore of the primary solenoid coil. The secondary magnet is mounted to the head section of the piston which is biased to a rest position adjacent the top of the coil. The distal end of the piston opposite the head section engages a switch that actuates the primary solenoid coil when the marker clip assembly including the locking mechanism is inserted into the central bore of the solenoid coil. When the switch is closed the circuit produces a pulsed capacitive discharge through the coil. Since the coil is only pulsed for a very short time, a very high current may be used. This high current produces a strong magnetic field that is capable of opening the locking mechanism of the marker. The secondary magnet then retains the locking mechanism in the open position until the marker is removed from the article and the clip assembly is removed from the release apparatus.

In accordance with a further aspect of the present invention, the electromagnetic release apparatus includes a marker removal reminder system that indicates when a marker is still attached to an article and the article is positioned at a final checkout station. Advantageously, this system substantially eliminates "false" alarms from properly purchased articles improperly processed by a cashier.

The marker removal reminder system includes interrogation and detection control circuitry, such as disclosed in the previously referenced U.S. Pat. No. 4,510,489 to Anderson, III, et al. The interrogation and detection circuitry is attached to interrogation and detection coils contained in the cashier counter or on a mat at the final checkout station where the purchased articles are bagged or sacked. This system is designed such that if an article, including a marker, is placed into the sack, the presence of the marker is detected and indicated, for example, by illuminating a light or sounding a horn.

Preferably, the light or horn remains continuously activated until such time as the article, with marker attached, is a removed from the sack and the release apparatus is activated to remove the marker. This prevents the cashier or clerk from deactivating the alarm without actually having removed the marker, thereby, assuring proper processing of the articles.

In accordance with yet another aspect of the present invention, the novel and improved method of marker removal from a protected article is provided. The method includes the step of energizing a primary electromagnet to produce a first magnetic field sufficient in force to open the locking mechanism of a marker. This includes the concept of pulsing the electromagnet to substantially eliminate or at least minimize electromagnetic heating even during periods of near continuous operation. The next step involves applying a secondary magnetic field from a secondary magnet to the marker locking mechansim. This secondary field is of sufficient force to maintain the lock mechanism in the open position following actuation.

The method may also include the additional step of indicating the presence of a marker attached to an article if placed in the zone of a final checkout station until the energizing step is initiated to remove the marker from the article. As indicated above, such a step advantageously assures proper processing of the article by the clerk or cashier and, therefore, reduces false alarms initiated by properly purchased articles.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawings.

DETAILED DESCRIPTION OF THE INVENTION

Figure 1:
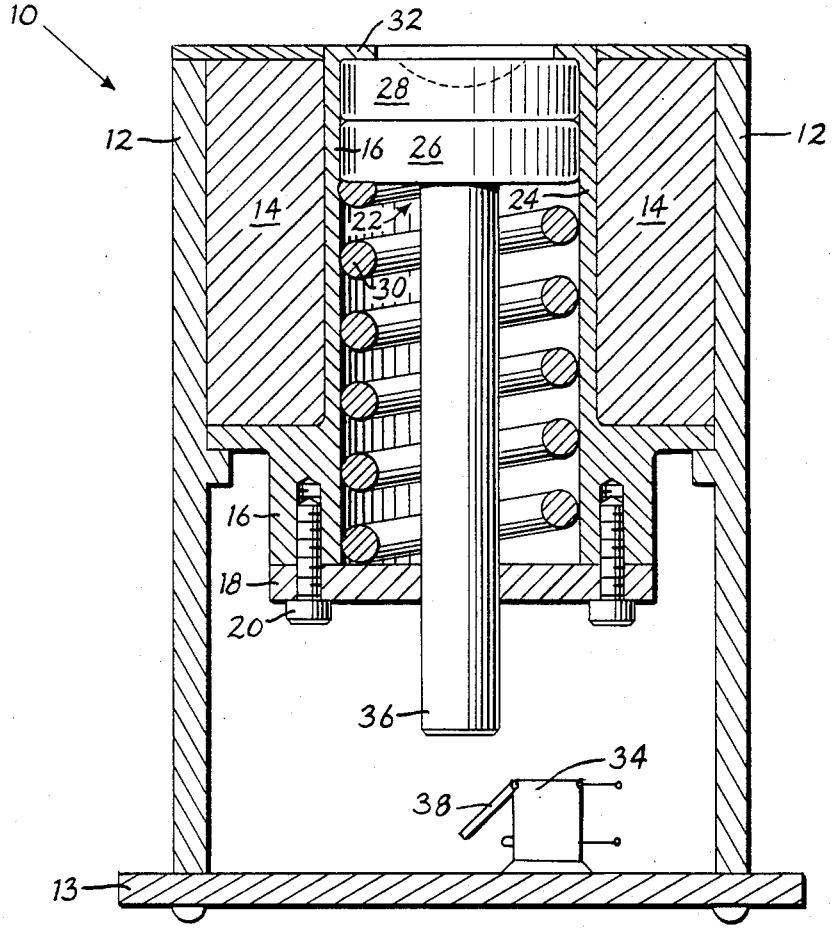
FIG. 1 is a schematical representation in cross section of the electromagnetic release apparatus of the present invention.
Figure 1A:
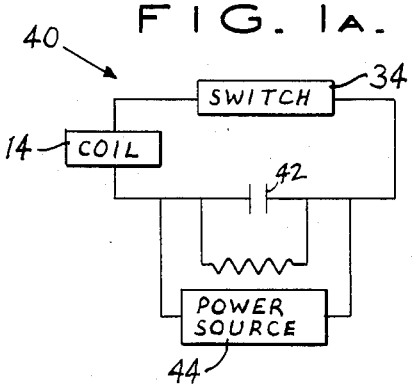
FIG. 1A is a schematic diagram of the electrical circuitry of the release apparatus.

Reference is now made to FIG. 1 showing the electromagnetic release apparatus 10 of the present invention. The apparatus 10 may be used to unfasten a surveillance marker clip assembly from an article when, for example, that article is purchased from a retailer and processed by a cashier or clerk. Such a marker clip assembly is shown in copending U.S. patent application Ser. No. 772,214, filed Sept. 3, 1985, entitled SURVEILLANCE MARKER CLIP ASSEMBLY, and incorporated herein by reference. It should be recognized, however, that the clip assembly forms no part of the invention claimed in this document.

Figure 4:
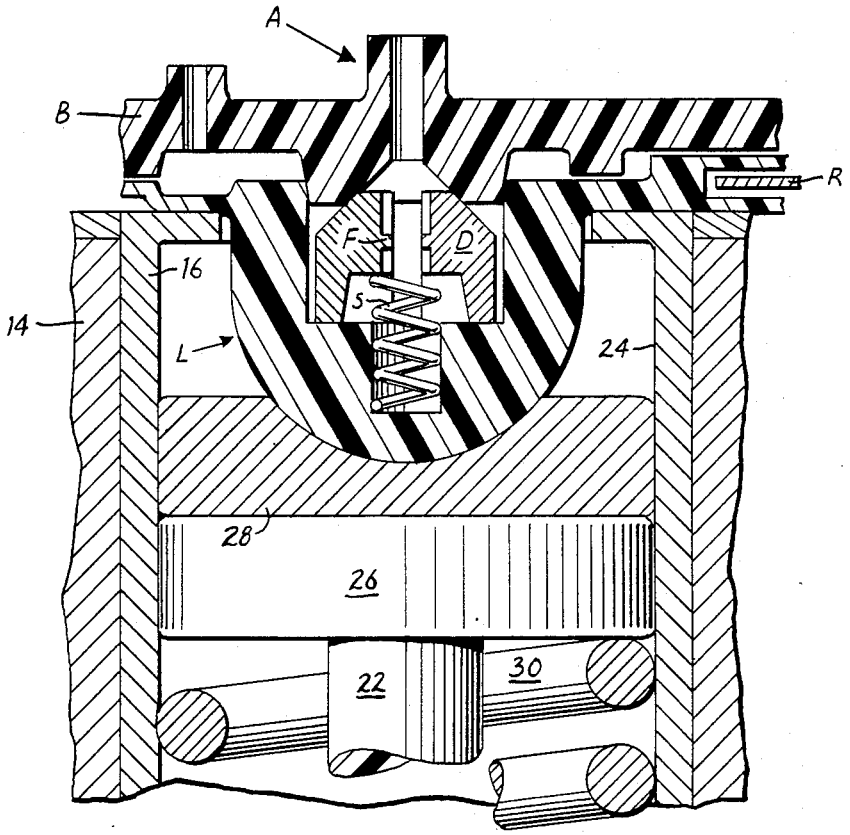
FIG. 4 is a detailed cross-sectional view showing the marker clip assembly fully inserted into the electromagnetic release apparatus and following activation of the release apparatus, the opening of the latching chocks and removal of the head to release the article.
Figure 5:
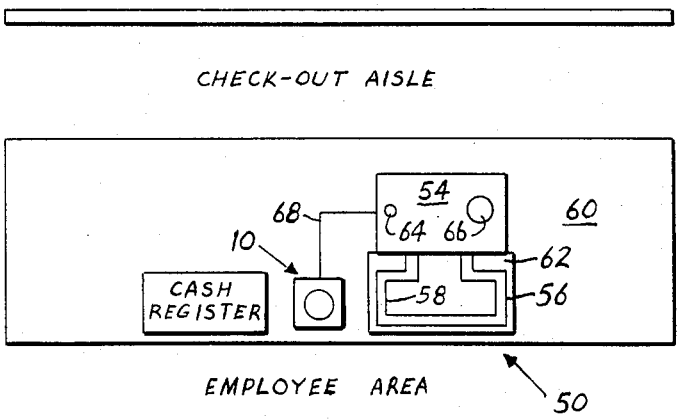
FIG. 5 is a schematical top view representation of a checkout area wherein the electromagnetic release apparatus is provided attached to a removal reminder system that indicates the presence of a marker on an article at the final checkout station.

As shown, the electromagnetic release apparatus 10 includes an external housing 12 and base 13 for suitable placement on a checkout counter 60 (see FIG. 5). A primary electromagnet, in the form of a solenoid coil 14, is positioned within the housing 12. When energized, the primary solenoid coil 14 produces a magnetic field of sufficient force to open the locking mechanism L of the surveillance marker clip assembly A (note FIG. 4). The primary solenoid coil 14 is mounted to a cylindrical support member 16 within the housing 12. As shown in FIG. 1, a cap 18 with screws 20 may be used to close the support member 16 at the lower end.

A piston 22 is slidably received in the central bore 24 of the primary solenoid coil 14. Mounted to the head section 26 of the piston 22 is a secondary magnet 28. The secondary magnet 28 may take the form of a strong permanent magnet or a low current electromagnet not subject to overheating. In either instance, the secondary magnet 28 produces a magnetic field of sufficient strength to maintain the locking mechansim L of the marker clip assembly A is an open position once it is opened by energization of the primary electromagnet 14.

A coil spring 30 biases the piston 22 to a rest position wherein the secondary magnet 28 is in contact with the upper wall or lip 32 of the support member 16. Of course, it should be appreciated that the lip 32 retains the piston 22 against the coil biasing spring 30, in the central bore 24 of the primary solenoid coil 14.

A "one-shot" miscroswitch 34 is housed in the base member 18. The normally open microswitch 34 is closed when the locking mechanism L of the surveillance marker clip assembly A is inserted into the central bore 24 of the primary solenoid coil 14 and pressed downwardly. Specifically, upon full insertion of the locking mechanism L, the piston 22 is pushed downwardly (note action arrow J in FIG. 2) against the spring 30 so that the distal end 36 of the piston rod contacts and pivots the switch lever 38. This closes the switch 34 and energizes the primary solenoid coil 14 to open the locking mechanism L, as described in greater detail below.

Advantageously, the locking action of the clip assembly A can be made to be very strong and secure when the release apparatus 10 of the present invention is being used. This is made possible due to the use of this relatively strong magnetic force that is provided through the primary coil 14. Once opened, the secondary magnet 28 maintains the locking mechanism L in the open position for convenient removal of the marker clip assembly A from the article C. Thus, it should be appreciated that the primary solenoid coil 14 with its relatively strong magnetic force is energized during the opening of the locking mechanism L and that during all other times no current is flowing through the coil.

Preferably, a control circuit 40 is provided to assure that the coil 14 is only operated in this pulsed manner. Specifically, the control circuitry 40 includes a capacitor 42 that is connected to a power source 44 so as to remain continuously charged.

When the switch 34 is closed through the insertion of the locking mechanism L into central bore 24 so as to be within the solenoid coil 14, the charged capacitor 42 discharges through the coil. This causes the coil 14 to produce the high strength magnetic field of sufficient force to open the locking mechanism L of the clip assembly A for removal of the marker from the article.

Since the switch 34 is of a "one-shot" design, that is only remains closed for one shot or pulse of current lasting on the order of 5 milliseconds, a relatively high current may be used to energize the coil 4 and, thereby, produce a strong magnetic field that insures the opening of the clip assembly locking mechanism L. Further, despite the use of such high current, coil overheating is not a problem as no matter how long the clip assembly A is held in the release position on the apparatus 10, only one pulse of current from the capacitor 42 is discharged through the coil.

The particular marker clip assembly A and locking mechanism L, briefly described above and shown in FIGS. 2–4, is adapted for securely fastening to a cloth article C, to allow surveillance or identification of that article. The preferred structure is more fully described and claimed in the copending application, mentioned above, so that only a general description is required here to understand the present invention. The marker assembly A includes a head section H and a body section B. One or more elongated, ductile ribbons R of magnetrostrictive material are housed in the body section B. Each ribbon R is preferably a strip of amorphous metal adapted to be magnetically biased and, thereby, armed to resonate mechanically at a standard or known frequency to generate an identifiable signal. The magnetic biasing may, for example, be provided by a separate ferromagnetic slab or plate of high magnetic coercivity or the housing may be molded from plastic impregnated with barium ferrite or other powder of high magnetic coercivity.

Figure 2:
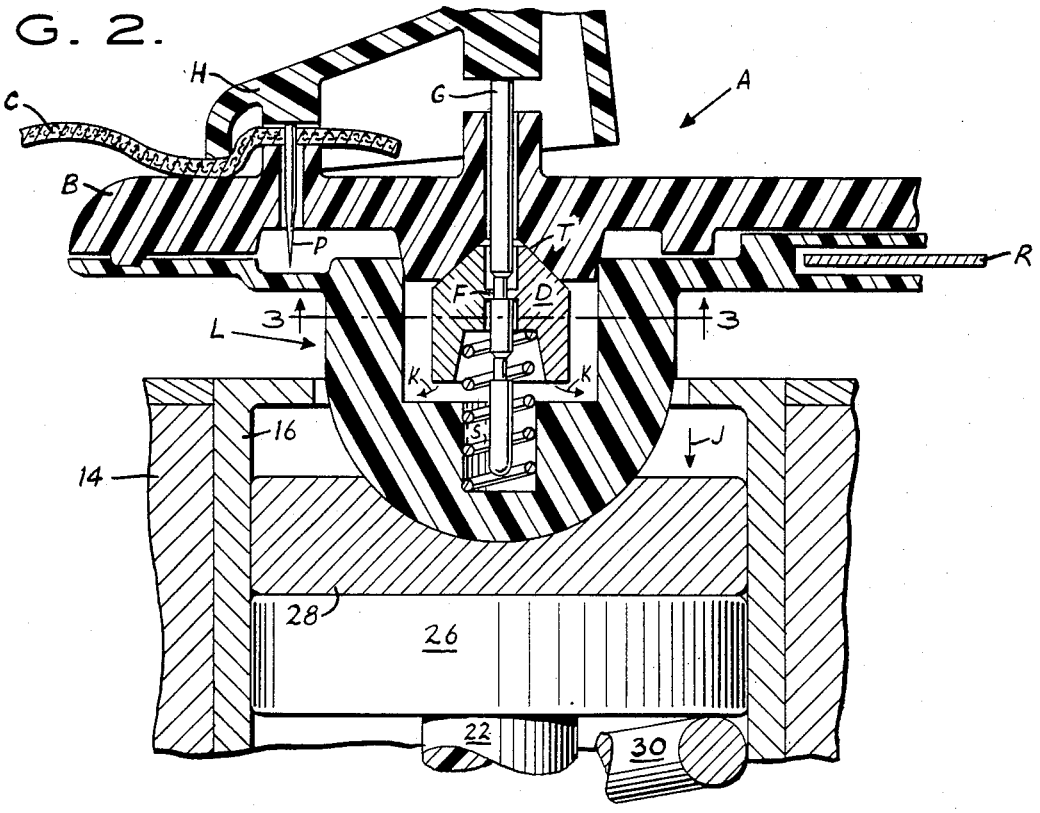
FIG. 2 is a detailed cross-sectional view showing the insertion of a marker clip assembly including a locking mechanism, into the coil core of the electromagnetic release apparatus of the present invention.
Figure 3:
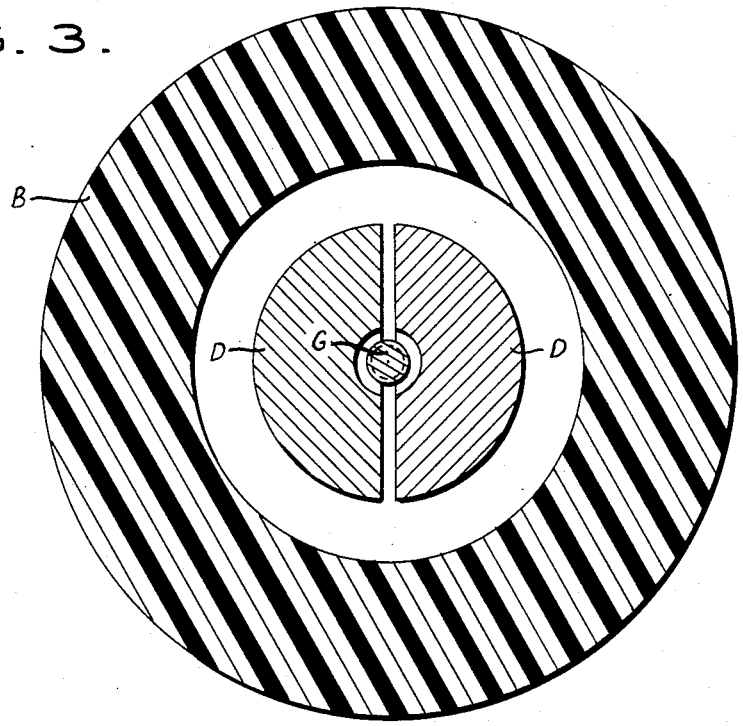
FIG. 3 is a cross-sectional view along line 3—3 of FIG. 2 through the latching chocks of the locking mechanism of the marker clip assembly.

The marker assembly A includes a smooth pin for piercing the article C. Positive retention and securing of the head and body section H, B together and to the article C is provided by means of a grooved pin G and the cooperating locking mechanism L. As shown in FIG. 2, when the head and body sections H, B are joined together and to the article C, the grooved pin G extends down into and engages the locking mechanism L in the body-housing section B.

A pair of cooperating ferromagnetic chocks D are biased together by means of cooperating cam surfaces T. Inwardly extending flanges F on the chocks D are received within one of the grooves of the grooved pin G to positively lock and prevent removal of the marker from the article C by a shoplifter. It should be appreciated, however, that the head and body sections H, B may be easily separated by authorized personnel, such as a clerk or cashier, using the specially designed electromagnetic release apparatus of the present invention.

In operation, as shown in FIG. 2, the portion of the clip assembly housing B that includes the locking mechanism L is inserted and pressed downwardly (note action arrow J) into the central bore 24 of the primary solenoid coil 14. When fully inserted as shown in FIG. 4, the distal end 36 of the piston 22 closes the microswitch 34 to energize the primary solenoid coil 14. The magnetic field produced by the energization of the solenoid coil 14 serves to pull the latching chocks D downwardly and outwardly in the direction of action arrows K (FIG. 2).

The magnetic field produced by the secondary magnet 28 is of sufficient force alone to retain the ferromagnetic chocks D once in this open or separated position. Therefore, energization of the primary coil is only necessary to open the chocks and during all other times no current is running through the coil and, therefore, overloading and overheating are substantially eliminated. With the chocks D maintained in the separated or open position, the attendant may easily remove the head section H of the housing by pulling the grooved from the locking mechanism L. This, of course, also serves to remove the smooth pin S from the article C and the unfastening of the complete marker assembly from the article.

As schematically shown in FIG. 5, the electromagnetic release apparatus 10 of the present invention may also include a target removal reminder system generally designed by reference numeral 50. This detects the presence of a marker at a final checkout station defined by a mat 62 on the counter 60, where for example, the purchased articles are sacked or bagged. Advantageously, the target removal reminder system 50 substantially eliminates 'false' alarms resulting when purchased, yet, improperly processed goods are removed from the store by the customers.

The target removal reminder system 50 includes control means, generally represented and shown at 54 and connected by line 68 to the release apparatus 10, for energizing an interrogation coil 56 and receiving and processing a signal from a detection coil 58. The interrogation and detection coils 56, 58 are contained within the checkout station mat 62. Preferably, the counter 60 is designed so that the final checkout station where the interrogation and detection takes place is only conveniently accessible to authorized personnel (note FIG. 5). This prevents customers from setting goods on the mat and needlessly setting off the removal reminder system.

A light 64 is illuminated and/or a horn 66 is sounded when a marker assembly A enters the zone above the final checkout station. Further, the signal remains active until such time as the article C with the attached marker assembly A is removed from the zone and the electromagnetic release apparatus 10 is activated to unlock the marker locking mechanism L. Once this occurs, a signal is sent along the line 68 to the input terminal of light 64 and/or horn 66 of the target removal reminder system to deactivate the light 64 and/or horn 66. The light 64 or horn 66 will, however, become immediately reactivated as soon as any marker assembly A is again detected at the final checkout station.

As is clear from the above, the novel and improved method of the present invention may be briefly summarized as follows. The first step involves energizing the primary electromagnet or solenoid coil 14 to produce a magnetic field of sufficient force to open or separate the latching chocks D of the clip assembly locking mechanism L. The next step involves applying a second magnetic field of sufficient but considerably lesser force to maintain the chocks D in the separated or opened condition. With the chocks D held in the open position shown in FIG. 4, the clerk or attendant may easily pull the grooved pin G from the article C.

In order to reduce heating of the primary coil 14, the method includes the step of simply pulsing the coil during energization. This concept is accomplished by discharging the electrical charge in a capacitor of the control circuit. The electromagnetic force is sufficiently large to quickly and efficiently disengage the chocks D, whereas a low power magnet, such as a permanent magnet, could not do so.

An additional and final step of the inventive method includes the step of indicating the presence of a marker assembly A at a final checkout station on the mat 62. An alarm sounds until the marker assembly is removed from the zone at the station and the energizing step of the release assembly 10 is initiated to remove the marker from the article.

In summary, numerous benefits result from employing the a pparatus and method concepts of the present invention. Full force locking of the chocks D by the cams T cooperating with the spring S can be relied on to hold the marker assembly A firmly to the article C. The electromagnetic coil 14 has sufficient power to quickly and efficiently release the chocks D. Overloading and overheating of the coil 14 of the electromagnetic release apparatus 10 is avoided by interruping the coil operation once the chocks D are open. This is possible by provision of a secondary magnet 28, preferably a relatively low power permanent magnet, that maintains the locking mechanism of a marker assembly in the unlocked position once opened. The release apparatus of the present invention also includes a target removal reminder system 50 to remind authorized personnel to properly process an article by removing the marker clip assembly A.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, a peripheral spring fabricated of piano wire or the like and positioned around the chocks D at approximately the line 3—3 of FIG. 2 can be used to assist the camming action in keeping the chocks closed, if desired or necessary. The embodiments was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An electromagnetic release apparatus for removing a surveillance marker of the like from an article wherein said marker includes a magnetically actuated locking mechanism for fastening the marker to the article, comprising:

primary electromagnet means for producing a first, strong magnetic field of sufficient force to open said marker locking mechanism;

secondary magnet means for producing a second magnetic field of lesser strength than said first magnetic field but having sufficient force to retain said marker locking mechanism in an open position once opened by said primary electromagnet means;

actuating means for energizing said primary electromagnet means to provide said first magnetic field; and means for deactivating said primary electromagnet means within a preselected period of time following energization thereof to substantially eliminate overheating and overloading of said primary electromagnet means during marker removal from an article.

2. The electromagnetic release apparatus set forth in claim 1, wherein said primary electromagnet means is in the form of a solenoid coil having a central bore.

3. The electromagnetic release apparatus set forth in claim 2, wherein piston means are slidably received in said central bore of said primary solenoid coil.

4. The electromagnetic release apparatus set forth in claim 3, wherein means are provided for biasing said piston means to a rest position.

5. The electromagnetic release apparatus set forth in claim 4, wherein said piston means includes a head section supporting said secondary magnet means.

6. The electromagnetic release apparatus set forth in claim 5, wherein said piston means includes a distal end opposite said head section and switch means are provided for actuating said primary coil; said distal end of said piston means activating said switch means to actuate said primary coil when said head section of said piston means is pushed down by inserting said marker into said central bore.

7. The electromagnetic release apparatus set forth in claim 6, wherein a substantially cylindrical support member is provided, said primary coil being concentrically disposed around said support member and said support member serving to define said central bore for slidably receiving said piston means.

8. The electromagnetic release apparatus set forth in claim 7, wherein said support member is mounted on a base member housing said switch means.

9. The electromagnetic release apparatus set forth in claim 8, wherein said support member includes an upper wall opposite said base member for maintaining said head section of said piston means within said central bore when in said rest position, said upper wall including an aperture overlying said secondary magnet means for the receipt of said marker.

10. The electromagnetic release apparatus set forth in claim 1, wherein circuit means are provided for pulsed operation of said primary electromagnet means so as to substantially eliminate overheating.

11. The electromagnetic release apparatus set forth in claim 10, wherein said circuit means is a pulsed capacitor discharge circuit.

12. The electromagnetic release apparatus set forth in claim 1, wherein said secondary magnet means is a permanent magnet.

13. The electromagnetic release apparatus set forth in claim 1, wherein said apparatus further includes marker removal reminder means for substantially eliminating false alarms from properly purchased articles improperly processed by a cashier.

14. The electromagnetic release apparatus set forth in claim 13, wherein said marker removal reminder means includes interrogation and detection means for determining the presence of a marker at a final checkout station and means for indicating to a cashier that a marker is fastened to the article.

15. The electromagnetic release apparatus set forth in claim 14, wherein said interrogation and detection means includes control circuitry and a mat containing both interrogation and detection coils, said mat being positioned adjacent a cashier counter at a final checkout station where the cashier handles the articles being purchased.

16. The electromagnetic release apparatus set forth in claim 14, wherein means are provided for continuously indicating the presence of a marker on the article being purchased until such time as the release apparatus is actuated to remove the marker from the article.

17. The electromagnetic release apparatus set forth in claim 16, wherein said indicating means is a light.

18. The electromagnetic release apparatus set forth in claim 16, said indicating means is a horn.

19. A method of removing a surveillance marker of the like from an article, wherein said marker includes a magnetically actuated locking mechanism for fastening the marker to the article, comprising the steps of:

energizing a primary electromagnet to produce a first, strong magnetic field sufficient in force to open said marker locking mechanism;

applying a second magnetic field from a secondary magnet to said marker locking mechanism, said second magnetic field being of lesser strength than said first magnetic field but having a force sufficient to maintain said marker locking mechanism in an open position once opened by energizing said primary electromagnet; and deactivating said primary electromagnet within a preselected period of time following energization thereof to substantially eliminate overheating and overloading of said primary electromagnet during marker removal from an article.

20. The method set forth in claim 19, wherein said energizing step includes the step of pulsing the electromagnet.

21. The method set forth in claim 19, including the additional step of indicating the presence of a marker attached to an article at a final checkout station until said energizing step is initiated to remove the marker from the article.

* * * * *